United States Patent [19]

Yates

[11] Patent Number: 4,711,600

[45] Date of Patent: Dec. 8, 1987

[54] HEATING DEVICE FOR USE WITH ASPHALT PAVEMENT RESURFACING EQUIPMENT

[76] Inventor: Larry A. Yates, 889 Gardendale Dr., Columbia, S.C. 29201

[21] Appl. No.: 689,717

[22] Filed: Jan. 8, 1985

[51] Int. Cl.[4] ..... E01C 23/14

[52] U.S. Cl. ..... 404/95; 126/271.2 A

[58] Field of Search ..... 404/75, 77, 79, 90, 404/91, 95; 126/271.2 A

[56] References Cited

U.S. PATENT DOCUMENTS

| | | | |
|---|---|---|---|
| 1,464,481 | 8/1923 | Henderson | 404/79 |
| 3,066,582 | 12/1962 | Cutler | 404/95 |
| 3,724,445 | 4/1973 | Cutler | 126/271.2 A |
| 3,865,098 | 2/1975 | Cutler | 126/271.2 A |
| 3,874,366 | 4/1975 | Cutler | 126/271.2 A |
| 3,997,276 | 12/1976 | Jackson, Sr. | 404/77 |
| 4,226,552 | 10/1980 | Moench | 404/77 X |
| 4,261,669 | 4/1981 | Edo | 404/77 |
| 4,319,856 | 3/1982 | Jeppson | 404/79 |
| 4,335,975 | 6/1982 | Schoelkopf | 404/77 |

FOREIGN PATENT DOCUMENTS

| | | | |
|---|---|---|---|
| 2362968 | 12/1978 | France | 404/95 |

*Primary Examiner*—James A. Leppink
*Assistant Examiner*—John F. Letchford
*Attorney, Agent, or Firm*—F. Rhett Brockington

[57] ABSTRACT

An asphalt pavement heating device, for use with an asphalt pavement recycling or repair apparatus which uses heaters to warm the asphalt to a pliable form thereby facilitating the recycling or repair process, wherein a pressurized combustible gaseous mixture of fuel and air is burned in a non-oxidizing blue hot flame which is impinging the pavement surface, said flame being formed in a firebox which is suspended on the front and/or underneath the carriage of the apparatus over the heated surface, said firebox having flexible or "sealing curtain type" side walls which drape to the surface thereby excluding the entrance of ambient air, said device being characterized by its capabilities to rapidly heat asphalt concrete pavement and its smokeless exhaust.

1 Claim, 6 Drawing Figures

FIG.1
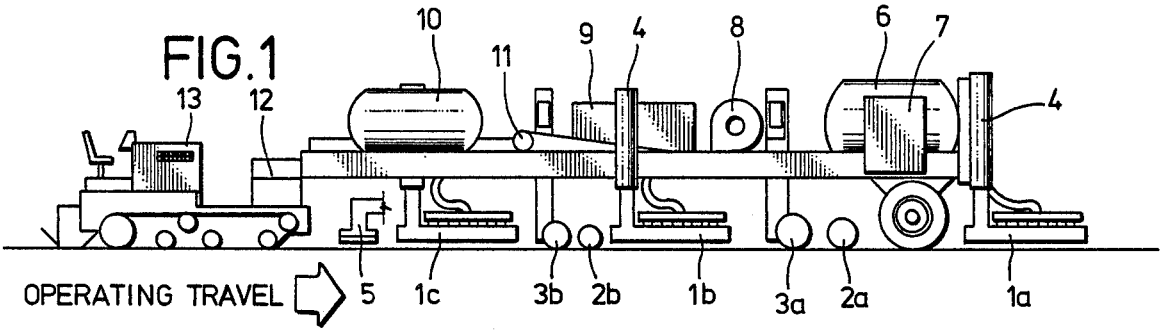
FIG.2
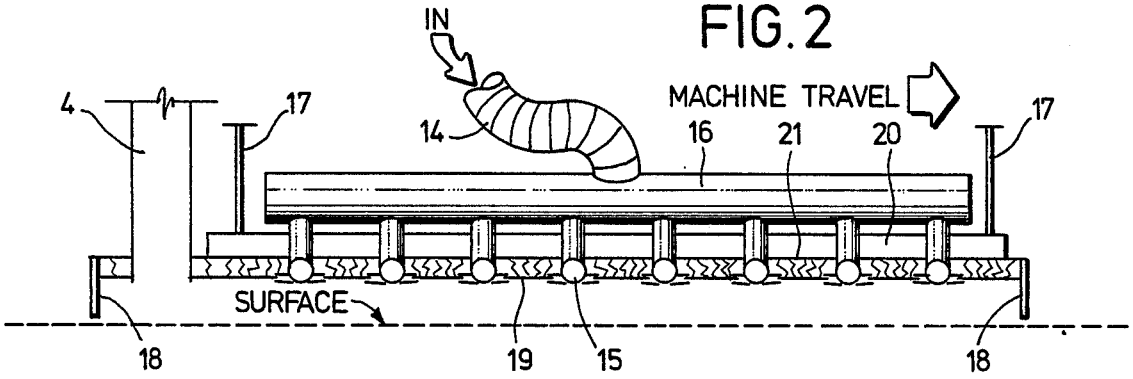
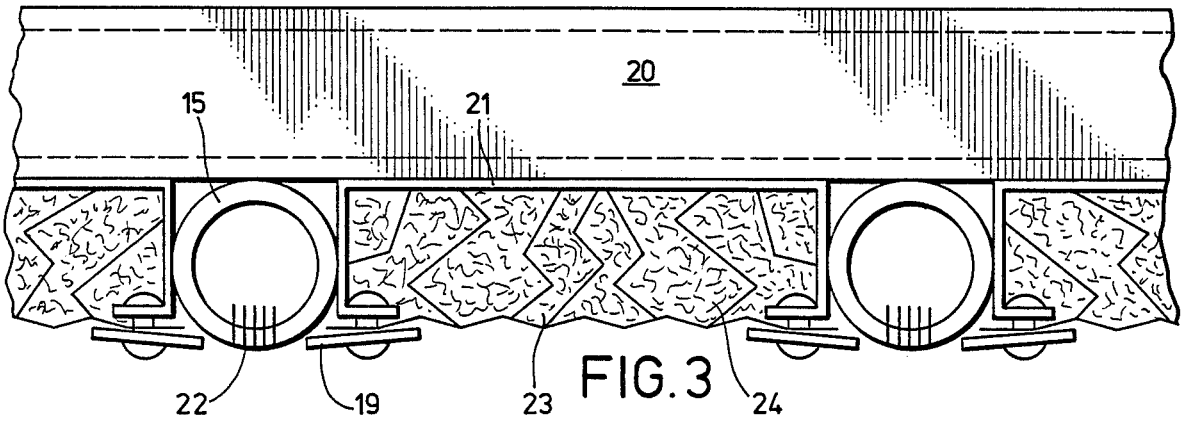
FIG.3

HEATING DEVICE FOR USE WITH ASPHALT PAVEMENT RESURFACING EQUIPMENT

BACKGROUND OF THE INVENTION

The invention relates generally to asphalt pavement resurfacing equipment, as typified by a recycling apparatus, and more specifically to asphalt pavement heating devices which are utilized at one or more work stations located on the pavement recycling apparatus.

Asphalt pavement recycling apparatus, in general, as set forth in my copending application, Ser. No. 06/597,205, provide a means for resurfacing a roadway in which a substantial portion of the newly laid asphalt concrete is recycled material drawn form the existing roadbed. Existing pavement is viewed by the Federal Highway Department as a federal resource, and the use of this resource through recycling results in the conservation of asphaltic materials and usually in reduced paving costs.

The level of performance of a pavement recycling apparatus that employs some form of energy to heat the asphalt to a pliable state prior to working the surface is closely tied to the effectiveness of the heating device. The effectiveness of a heating device can be gauged on four criteria.

1. The time required to heat a specified depth of asphalt pavement to a predetermined temperature with an acceptable level of surface degradation. Asphalt concrete compositions become pliable at 250° F., and so this is a commonly used minimum target temperature.
2. The cost in terms of energy of heating the asphalt.
3. The ability of the heating device to withstand the rigors associated with heavy equipment related road construction.
4. The environmental impact incidental to the operation of the heating device.

The instant invention distinguishes itself in each of the four criteria.

Billowous, black fuming smoke has historically been associated with direct flame impingement asphalt cement heaters. Heretofore it has been thought necessary that to prevent degradation indirect, "non-oxidizing" heaters had to be used, and in response a variety of methods have been developed. Most have used some form of radiant energy, either infrared (U.S. Pat. No. 3,865,098 Cutler) or Microwave (U.S. Pat. No. 4,319,856 Jeppson), while others used a non-flammible medium such as steam (U.S. Pat. No. 4,261,669 Edo). A gas fired ceramic heater can operate at temperatures as high as 2100° F., while most operate in the range of 1400°-1600° F. Gas fired infrared heaters will degrade the asphalt and smoke if the pavement surface reaches a temperature in excess of 500° F. in the presence of air.

Infra-red heating generally reduces the level of oxidation as compared to most open flame burners, however, current asphalt pavement resurfacing equipment employing this energy source still generates significant, undesirous amounts of black smoke. This suggests that degradation is still occurring, and the mechanism is probably via oxidation. Gas fired infrared ceramic heaters are relatively fragile in that the ceramic target element is friable and is easily subject to damage. To protect the ceramic element a metal guard screen is frequently inserted between the heater and the pavement surface. This improvement in durability, however, is somewhat off-set by the reduction in heat efficiency.

The radiant energy collected by the screen is reirradiated, however, at a lower temperature. Some heat of course will also be lost to the surroundings by conduction.

The art of heating high molecular weight organic materials is well known to those in the petroleum industry. Asphaltic materials are routinely refined using thermal cracking, and aluminum silicate salts, such as found in gravel, are employed as catalysis. It is imperative that the refining system be non-oxidative or else degradation occurs. The cruciality of maintaining a non-oxidative environment is not reflected in the literature reading on the art of heating asphalt pavement. Apparently some assumptions were made early on as to the reason why open flame heaters were impractical, and this resulted in emphasis on other methods. Open flame heaters are inherently simpler, cheaper and can be made more efficient than radiant heaters.

I have found that when using the heating device as disclosed herein that asphalt concrete can very quickly and efficiently be heated to a pliable state using direct flame impingement without either degrading the pavement or generatin the reported fuming, black smoke. The heating device operates so cleanly that the exhaust is virtually colorless.

SUMMARY OF THE INVENTION

The functional elements of the asphalt pavement heating device can be broadly divided into two major components determined by their locations on the asphalt pavement resurfacing equipment, and more specifically on an asphalt pavement recycling apparatus. One major component, the firebox, which includes the burners and the hood is positioned on the front and/or underneath the carriage of the apparatus. The other major component, the remote air-fuel mixing site, which includes a fuel tank, a fuel vaporizer, multiple regulators, safety equipment, air blower, air-fuel mixer, et cetera, rests on the upper chassis.

Typically an apparatus will have one or more fireboxes and only one remote air-fuel mixing site. The firebox is suspended over the pavement during operation with the burners being directed toward the surface. It is height and tilt adjustable to accomodate changing road conditions and contour. For transportation to and from the job site the firebox(s) can be raised to a height that permits over the road travel.

A non-oxidizing blue hot flame emanating from a matrix of burners housed in the hood of the firebox, impinges the surface of the asphalt Pavement. The flame temperature is in the range of 2200° F., depending on the choice of fuels.

Great emphasis has been placed on maintaining an environment within the firebox that is free of oxidizing gases and so even at the expense of loosing some heat a sufficient positive pressure is maintained to ensure that all ambient air is excluded from the firebox chamber. The matrix of burners is mounted on the interior, top of the hood. The burners may be of any variety including but not limited to the strip, slot, ribbon, area or orifice type. We have found ribbon burners to be very effective in that they ignite instantaneously with any gas and will retain the flame without flash-back on any degree of turndown. When operated on enclosed flame rating (premixed air-fuel) no seqondary air is required to sustain combustion, and they can be operated with the flame projecting in any direction. The preferred burner is commercially available from Ensign Ribbon Burners, Inc. The burners are supplied the air-fuel mixture through a set of distribution manifolds which are located on the exterior of the firebox. The interior of the hood is lined with nonflammible insulation to a depth equal to the level where the flame emerges from the burner. The copious amount of insulation permits a relatively high concentration of burners in the firebox. The preferred insulation is ceramic fiber. Ceramic fiber has a high emissivity, and therefore, fractous radiant energy generated by the flame will be re-irradiated onto the asphalt surface. Wire mesh supports help the ceramic fibers to weather normal wear and tear.

The sidewalls of the firebox are constructed such that they are nearly co-extensive with the surface of the asphalt pavement, thereby providing an occlusive barrier to entrance of air and escape of spent and burning gases. The preferred construction employs the use of a nonflammible, flexible material which circumvents the hood and drapes like skirt from the hood to the pavement surface. The skirt can be constructed of any suitable material including but not limited to self adjusting metal slats, mail and reinforced, woven, ceramic fiber supported by wire mesh.

The hood is fitted with an exhaust stack(s) to duct away spent combustion gases. Some exhaust is lost through the sidewalls at the base of the skirt.

The translational motion of an operating recycling apparatus prevents the flame from impinging any point of the pavement surface for a sustained period of time and the surface temperature will be an average of the flame temperature and the hood temperature. The instant invention has been designed to maintain a surface temperature of approximately 1500° F. At the remote air-fuel mixing site the fuel, which is stored as a liquid, is vaporized, and then using pressure regulators to control the flow is injected into an airfuel mixer where it is mixed with pressurized air. A typical fuel ratio would be 24 parts air to 1 part propane. This mixture exits the mixer at a pressure of 0.5 to 3 inches of water. One and one half inches is normal. The nominal pressure on the firebox is one half inches. The pressurized air is generated with a blower. Heat from the hot gases exhausting through the firebox stack can be used to vaporize the liquified fuel.

The instant invention touches on the four criteria for an effective heater. Higher heat than can be genereted by gas fired radiant heaters are produced at the tip of the surface impinging flame. The high emmissivity insulation acts comparable to a radiant heater element. The combination of flame and insulation assures rapid deep heating of the asphalt concrete pavement. Typically a depth of one third inch can be heated to a minimum temperature of 250° F. in 15 seconds. This is faster than any asphalt pavement heating device reported in the literature. Heating is not only fast, it is also clean with very little surface degradation and with a virtually colorless exhaust. The environmental impact is minimal and in urban areas this would be critical to a recycling operation. Direct flame impingement heating results in economy of energy since no energy is lost in the process of converting to an indirect energy source. The burners, fuel, auxillary equipment are for the most part commercially available stock items. The device is relativel easy to maintain and has no fragile components which could be damaged by related recycling activities at other wofk stations. The instant invention, unlike infra red heaters, is not easily subject to damage by water, in that there are no ceramic heating elements that tend to absorb moisture, that when wet, crack and shatter upon flame ignition.

The asphalt pavement heating device can be adopted for asphalt pavement recycling apparatus, wherein one or more devices is fitted at each of the work stations on the apparatus. It can also be utilized in other resurfacing operations, such as a preheater for scarifying equipment, a preheater to pavement recycling equipment, a preheater for surface treatment prior to paving by a paving machine, and in conjunction with various other road repair operations.

BRIEF DESCRIPTION OF THE FIGURES

FIG. 1 is a side view of an Asphalt Pavement Recycling Apparatus which is fitted with three work stations (the first two stations having a firebox, a set of mills, and a pavement aggregate collector-elevator) and is pushed by standard paving machine which redeposits the recycled asphalt pavement as it is generated. The remote air-fuel mixing site which is carried on the carriage, generates and feeds a gaseous combustible mixture to the burners in each of the three fireboxes.

FIG. 2 is a cross sectional side view of the heating device firebox. The ribbon burner pipes are mounted parallel to the surface and perpendicular to the direction of machine travel. Note a flexible skirt which drapes to the surface of the pavement grade forms the side walls and the hood is formed by the juxtaposition of rectangular pans filled with insulation and burner pipes affixed to a super-structural metal frame.

FIG. 3 is an expanded view of FIG. 2. Burners are protected by stainless steel heat strips. These strips keep the burners cool, retain the flame and aid in maintaining a positive pressure inside the firebox. The burner pipes' top external walls are exposed to cooling ambient air.

DETAILED DESCRIPTION OF THE ILLUSTRATED EMBODIMENT

Figure 4:
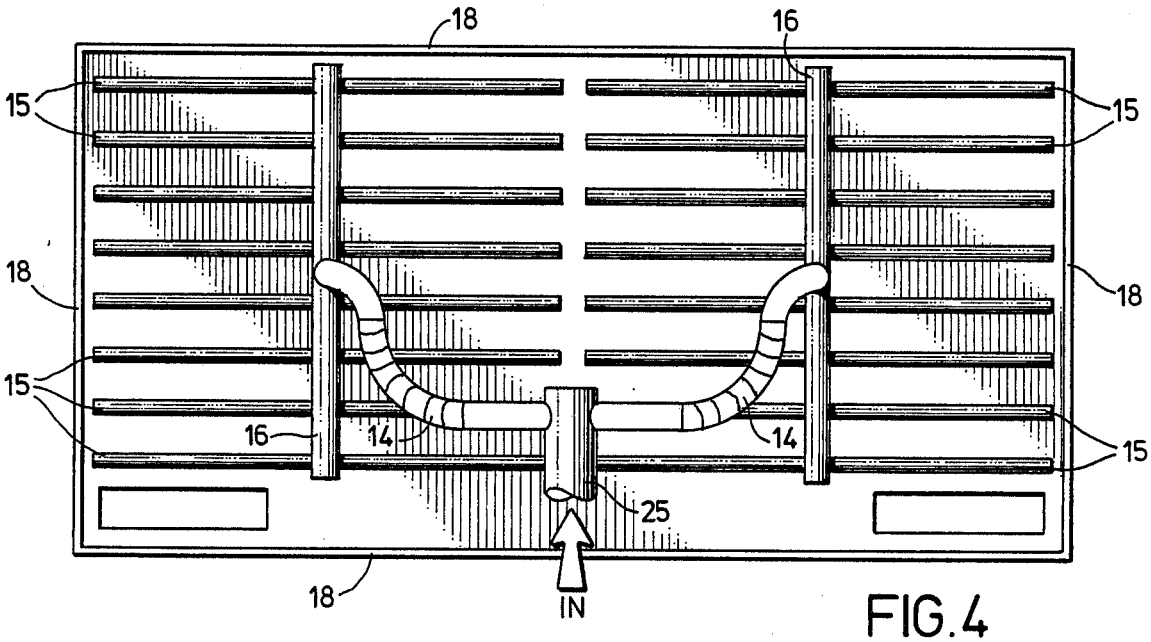
FIG. 4 is a plan external view of the firebox showing the location of exhaust stacks air-fuel distribution manifolds and flexible skirt.

The Asphalt Pavement Heating Device is designed for use with an Asphalt Pavement Recycling Apparatus and with other equipment used in road repair. FIG. 1 illustrates an embodiment of the device on a recycling apparatus. The apparatus including a standard paving machine 13 is sixty five feet long. It has three work stations, the first two of which have a firebox 1*a*, 1*b* to heat a depth of asphalt to a warm pliable state, mills for cutting, turning and mixing the softened asphalt pavement 2*a*, 2*b* and a collector and elevator 3*a*, 3*b* which collects the plowed material and raises it to the collection conveyor 11 where additives from the rejuvenator additive tank 10 can be admixed with the asphaltic aggregate therein rejuvenating the asphalt to a composition comparable to new asphalt concrete. The third work station has another firebox 1*c* and a scarifier 5 which in combination work to a warm and roughen the exposed surface thereby preparing an excellent surface to which the screeded recycled pavement can adhere. The apparatus is operated from the power unit-control station 9. A combustible mixture is formed by vaporizing propane which is stored in a pressure tank 6 in a vaporizor 7. Pressurized air is generated for all the burners by a combustion air blower 8. The recycling apparatus in FIG. 1 is fitted with a fifth wheel mount 12 for hauling it to and from the jobsite. Stacks 4 route the exhaust from the fireboxes. Firebox 1*a* which is hinged on the front of the apparatusis raised while the recycling apparatus is being hauled, and the other two fireboxes 1*b, 1c* are raised to their highest position. In the illustrated embodiment the three fireboxes are identical, however, certain justifications can be made for fabricating a system wherein the first heater is larger than the second, third, et cetera heaters.

Referring to.FIG. 2 which depicts a cross section, all of the fireboxes are suspended by support members 17 which enable the adjustment of the fireboxes' height and tilt to meet changing road contours. Twin sets of eight, 6 feet ribbon pipe burners 15 are housed in each firebox. The burners are fired by a stream of pre-mixed combustible air-fuel through twin flexible air-fuel hoses 14 into twin distribution manifolds 16. The burner pipes 15 are on 8 inch centers thereby creating a very high heat density furnace. The stack 4 is located at the rear of the firebox. The hood or top of the firebox is formed by the juxtapositional assembly of the burner pipes 15 and the rectangular insulation pans 21 which are fastened to the structural frame 20. The top of the burner pipes 15, the distribution manifold 16, the structural frame 20, and the top of the insulation pans 21 are all exposed to ambient air, and this insures that even though there is a very high density the heating device will operate cooly. The flexible skirt 18 circumvents the hood and drapes to the pavement surface. The flexible skirt 18 serves to both exclude ambient air and contain the spent combustion gases and flame, thereby creating a non-oxidative environment within the firebox chamber. Referring to FIG. 3, the cylindrical burner has a lengthwise slit opening which is fitted with corrugated stainless steel strips, off-set from each other by 180 degrees 22. The insulation 24 is formed of ceramic fibers. A restraining Inconel Mesh 23 holds the insulation in the pans 21. Heat shield strips 19 span the gap formed at the burner pipe 15 insulation pan 21 interface. These strips shield the pipe and prevent heat from escaping through the gap.

FIG. 4 illustrates how the elements of the firebox come together as seen in a plan view. The hood is twelve feet by six feet. A stationary air-fuel pipe 25 feeds to the twin flexible hoses 14.

Figure 5:
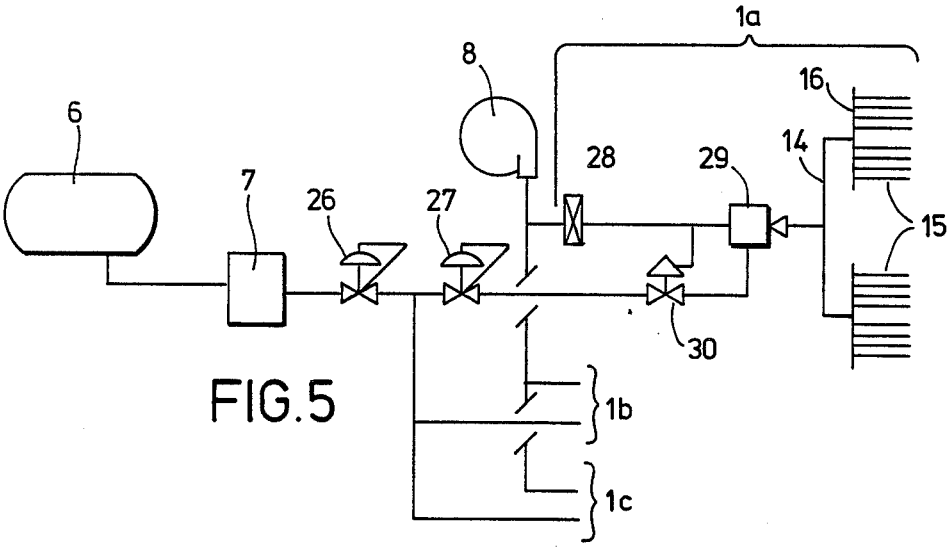
FIG. 5 is a schematic of remote air-fuel mixing site equipment.

FIG. 5 schematically depicts the air-fuel mixing process for a heating device having three burner boxes. Each of the burner boxes are supplied by its own air-fuel mixing system. The systems are identical and only one is shown in the Figure. The other systems are indicated by inference. Propane is piped from the pressurized tank 6 to the vaporizer 7 where it is converted into a gas. A primary pressure regulator 26 controls the fuel flow to each of the three burner assemblies 1*a*, 1*b*, 1*c*. A secondary pressure regulator 27 controls flow to the individual burner assemblies. A balanced zero regulator 30 senses the air line for pressure. Pressurized air, generated by the combustion air fan 8, is regulated by a butterfly volume control valve 28. The propane and air mix in the air-fuel ratio mixer 29. A pressure of approximately two inches of water is maintained on the eluting combustible gaseous mixture. Heat output for this system is approximately six million BTU/HR per firebox.

Figure 6:
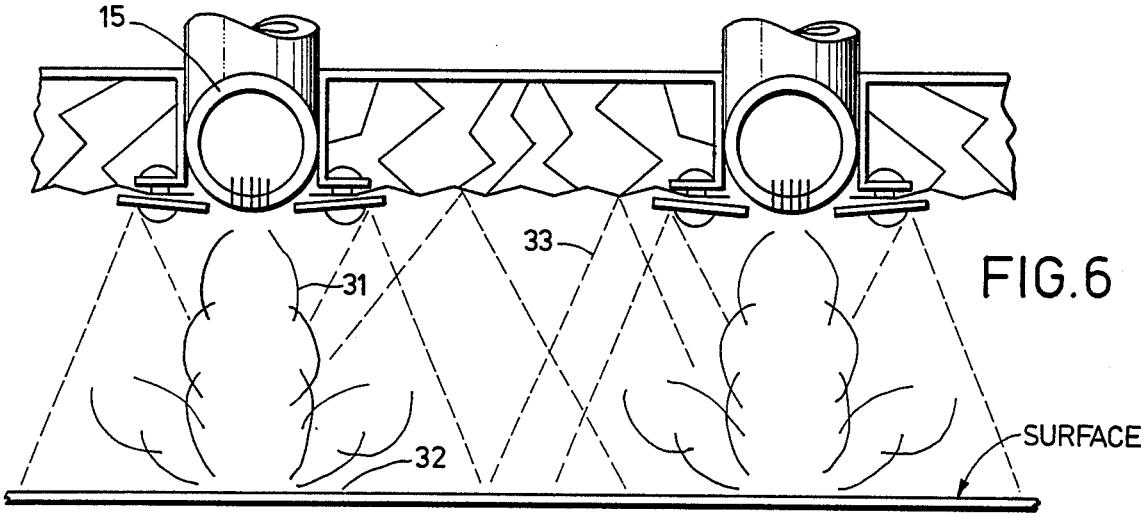
FIG. 6 is a cross sectional view of an operational pair of burners. The figure illustrates direct flame impingement and re-irradiation of high emissivity insulation.

FIG. 6 depicts an impinging blue hot pressurized flame 31 emanating from a burner 15. The end of the flame impinges the pavement surface 32. Fractous radiant energy 33 generated by the flame is re-irradiated on to the pavement surface.

What I claim is:

1. A device, for use on an asphalt pavement resurfacing apparatus traversing across the road surface, for the nondestructive, rapid, continuous heating of a depth of asphalt pavement from a temperature where the asphalt pavement is normally in a firm state to a higher temperature where the asphalt pavement is in a pliable state, at a rate of heating in which the heat output is sufficiently high to create temperatures which very rapidly bring up the surface temperature to a point where heat transfer through the depth is efficient and expedient, and that the elevated temperatures can be maintained with only miminal degradation of the asphalt pavement and consequential smoke, by the scrupulous exclusion of oxygen from the heated road surface, where said heating device consists of the elements of:

(a) equipment for generating a supply of a combustible mixture of pressurized gases to be burned in a burner assembly suspended over the road surface, said equipment consisting of a tank for holding the fuel, a means for vaporizing fuel fed from the tank, a primary pressure regulator for controlling the fuel to the burner assemblies, a secondary pressure regulator for controlling the fuel flow to an individual burner assembly, a blower for generating compressed air, an air control valve for regulating the flow of air to an individual burner assembly, a means for mixing and setting a selected ratio of fuel and air for an individual burner assembly, and a line for piping the gaseous mixture to an individual burner assembly, where the equipment enables the adjustment of the individual burner assemblies through a wide degree of turndown or ratio of gases;

(b) a burner assembly consisting of a structural frame onto which are mounted in a single layer, on the underneath side of the frame, a plurality of open flame, directional burners, a plurality of insulation pans filled with high emmissitivity insulation interspaced among and contiguous with the burners, and a flexible skirt mounted on the perimeter of the frame, which drapes from the frame to the surface of the road, where the combined elements of the frame, the burners, the insulation pans, the insulation and the skirt, together form a pressurizable burner chamber over the road surface, and where the burners, which serve as a partial wall of that chamber, are in direct contact with the cooling, outside air;

(c) suspension elements for attaching the burner assembly to the asphalt pavement resurfacing apparatus, where the suspension elements enable the burner assembly to be adjusted such that the assembly follows the road contour;

and when the device is in operation the heat output of the burner assemblies can be adjusted up to very high levels without seriously degrading the asphalt pavement by maintaining a pressure sufficiently positive in the burner chamber to occlude the entrance of outside air, even when said outside air is not uniformly pressurized as is the case with a wind.

* * * * *